US008235672B2

(12) United States Patent
Choi et al.

(10) Patent No.: US 8,235,672 B2
(45) Date of Patent: Aug. 7, 2012

(54) FAN

(75) Inventors: Seok Ho Choi, Seoul (KR); Deok Huh, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 873 days.

(21) Appl. No.: 12/176,628

(22) Filed: Jul. 21, 2008

(65) Prior Publication Data

US 2009/0110558 A1 Apr. 30, 2009

(30) Foreign Application Priority Data

Oct. 25, 2007 (KR) ..... 10-2007-0107527
Oct. 25, 2007 (KR) ..... 10-2007-0107530

(51) Int. Cl.

| | |
|---|---|
| ***B63H 1/26*** | (2006.01) |
| ***B63H 7/02*** | (2006.01) |
| ***B64C 27/46*** | (2006.01) |
| ***B64C 11/16*** | (2006.01) |
| ***F03B 3/12*** | (2006.01) |
| ***F03B 7/00*** | (2006.01) |
| ***F03D 11/02*** | (2006.01) |
| ***F04D 29/38*** | (2006.01) |
| ***F01D 5/14*** | (2006.01) |

(52) U.S. Cl. ..... 416/238; 416/244 R; 416/245 R; 416/234; 416/239; 416/237

(58) Field of Classification Search ..... None
See application file for complete search history.

(56) References Cited

U.S. PATENT DOCUMENTS

| | | | | |
|---|---|---|---|---|
| 1,051,852 | A * | 1/1913 | Treat | 415/222 |
| 1,991,095 | A | 2/1935 | Hochstetter | |
| 2,123,146 | A | 7/1938 | Preston | |
| 2,192,811 | A | 3/1940 | Cohen | |
| 2,208,084 | A | 7/1940 | Ryder | |
| 5,910,045 | A | 6/1999 | Aoki et al. | |
| 6,544,010 | B1 | 4/2003 | Choi | |
| 7,191,613 | B2 | 3/2007 | Lee | |
| 2004/0033138 | A1 | 2/2004 | Jung et al. | |
| 2005/0260075 | A1 | 11/2005 | Arinaga et al. | |
| 2008/0159865 | A1 | 7/2008 | Lee et al. | |
| 2008/0159872 | A1 * | 7/2008 | Park et al. | 416/244 R |

FOREIGN PATENT DOCUMENTS

| | | | |
|---|---|---|---|
| CH | 303021 (A) | | 11/1954 |
| EP | 1 164 295 | A1 | 12/2001 |
| EP | 1422425 | A2 * | 5/2004 |
| FR | 1.458.587 (A) | | 3/1966 |
| JP | 2002-106494 | A | 4/2002 |
| JP | 2006152988 | A * | 6/2006 |
| KR | 10-1997-0001999 | | 1/1997 |
| KR | 10-2000-0045688 | A | 7/2000 |
| KR | 10-2000-0045689 | A | 7/2000 |
| WO | WO 2006078083 | A2 * | 7/2006 |

* cited by examiner

*Primary Examiner* — Julio J Maldonado
*Assistant Examiner* — Shantanu C Pathak
(74) *Attorney, Agent, or Firm* — McKenna Long & Aldridge LLP

(57) ABSTRACT

A fan includes a hub and a plurality of blades formed on the hub with a rake angle. In an axial direction of the hub, no part of a trailing edge of any of the blades is disposed past an air outlet end of the hub at more than a distance approximately equal to 25% of a diameter of the hub.

9 Claims, 9 Drawing Sheets

Related Art

Related Art

Related Art

FAN

CROSS-REFERENCE TO RELATED APPLICATIONS

This application claims the benefit of Korean Patent Application No. 10-2007-0107527, filed on Oct. 25, 2007, and Korean Patent Application No. 10-2007-0107530, filed on Oct. 25, 2007, which are hereby incorporated by reference in their entireties.

BACKGROUND OF THE INVENTION

The present disclosure relates to a fan.

A fan is a device for producing an air flow. An axial fan is a type of fan which takes in and discharges air along a shaft of the axial fan.

An axial fan includes a plurality of blades disposed on an outer surface of a hub. When an axial fan rotates, air flows from a leading edge of a blade to a trailing edge of the blade, along a positive pressure surface of the blade.

As a conventional axial fan rotates, the greatest amount of pressure is applied to center portions of the positive pressure surfaces of the blades, and the lowest pressure is applied near the trailing edges of the blades. As the fan rotates, air separates from the blades at the trailing edge of each blade, which creates noise. This air separation also reduces the blowing performance of the axial fan.

For the purpose of improved blowing performance, the hubs of some conventional fans have a cone-like shape. However, a problem with such fans is that a die-lock often occurs during the molding process. That is, when a fan is molded using a two-plate mold, the mold plates are often difficult to separate after the molding process. This problem can increase the manufacturing costs for the fans.

Characteristics of a blade which affect the blowing performance and noise characteristic of a fan include a sweep angle, a rake angle, a pitch angle, a camber, and a position of the camber.

FIG. 1 is a plan view illustrating a sweep angle Ψ of a related art axial fan.

Referring to FIG. 1, a point P1 is defined as a center point of a portion of a blade 50 which is connected to a hub 10. A point P2 is defined as a center point of an outer edge 58 of the blade 50. A sweep angle Ψ is defined as an angle between a first imaginary line connecting the point P1 to the center of the hub 10 and a second imaginary line connecting the point P2 to the center of the hub 10.

FIG. 2 is a perspective view illustrating a rake angle γ of the related art axial fan.

Referring to FIG. 2, the rake angle γ is defined as an angle between a third imaginary line connecting the point P1 to the point P2 and a fourth imaginary line which is perpendicular to a rotation axis of the hub 10. The rake angle γ refers to how the blade 50 is inclined from the fourth imaginary line, which is perpendicular to the rotation axis of the hub 10.

FIG. 3 is a perspective view illustrating a pitch angle θ of the related art axial fan.

Referring to FIG. 3, the pitch angle θ is defined as an angle between a fifth imaginary line which connects the ends of the portion of the blade 50 connected to the hub 10 and a sixth imaginary line which is parallel to the rotation axis of the hub 10. The pitch angle θ refers to how much the blade 50 is twisted relative to the rotation axis of the hub 10. A camber is defined as the amount of concavity of a positive pressure surface 51 of the blade 50 with respect to a negative pressure surface 52 of the blade 50.

SUMMARY OF THE INVENTION

One of the features of the fan of the present invention is that it minimizes an air separation near a trailing edge of a fan blade, thereby minimizing noise and improving the blowing performance of the fan. Other features of the fan are that air is effectively diffused from its hub, and the fan is relatively easy to mold.

These features may be provided by a fan which includes a hub and a plurality of blades formed on the hub with a rake angle. In an axial direction of the hub, no part of a trailing edge of any of the blades is disposed past an air outlet end of the hub at more than a distance approximately equal to 25% of a diameter of the hub.

The trailing edge of each of the blades may lie in a plane perpendicular to the axial direction of the hub. Each of the blades may include a camber near its respective trailing edge. Each of the rake angles may be between approximately 4° and approximately 8°.

An outer surface of the hub may include an inclined portion, along which a radius of the outer surface of the hub increases in a direction from an air intake end of the hub to the air outlet end of the hub. At the air intake end of the hub, a cross-section of the hub may be in the shape of a circle. The inclined portion may be disposed in a radial direction between a leading edge of one of the plurality of blades and a trailing edge of an adjacent blade.

Along the inclined portion, a radius of the outer surface of the hub may decrease in the radial direction from the leading edge of the one blade to the trailing edge of the adjacent blade. The inclined portion may extend from the air intake end of the hub to the air outlet end of the hub.

Also disclosed is a fan which includes a hub and a plurality of blades formed on the hub. An outer surface of the hub includes an inclined portion, along which a radius of the outer surface of the hub increases in a direction from an air intake end of the hub to the air outlet end of the hub, the inclined portion is disposed in a radial direction between a leading edge of one of the plurality of blades and a trailing edge of an adjacent blade, and a radius of the outer surface of the hub decreases in the radial direction from the leading edge of the one blade to the trailing edge of the adjacent blade.

At the air intake end of the hub, a cross-section of the hub may be in the shape of a circle. The inclined portion may extend from the air intake end of the hub to the air outlet end of the hub.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to embodiments of the present invention, examples of which are illustrated in the accompanying drawings. Although embodiments have been described with reference to a number of illustrations, it should be understood that numerous other modifications and embodiments can be devised by those skilled in the art that will fall within the spirit and scope of the principles of this disclosure.

Figure 1:
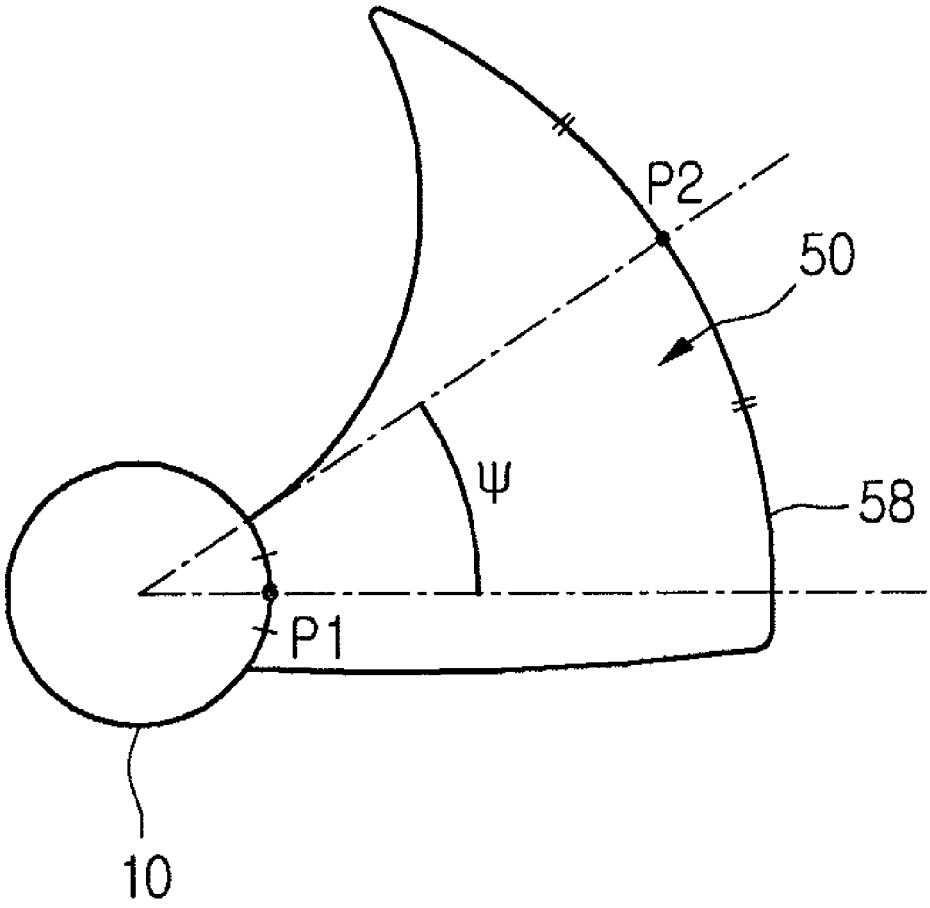
FIG. 1 is a plan view illustrating a sweep angle of a related art axial fan.
Figure 2:
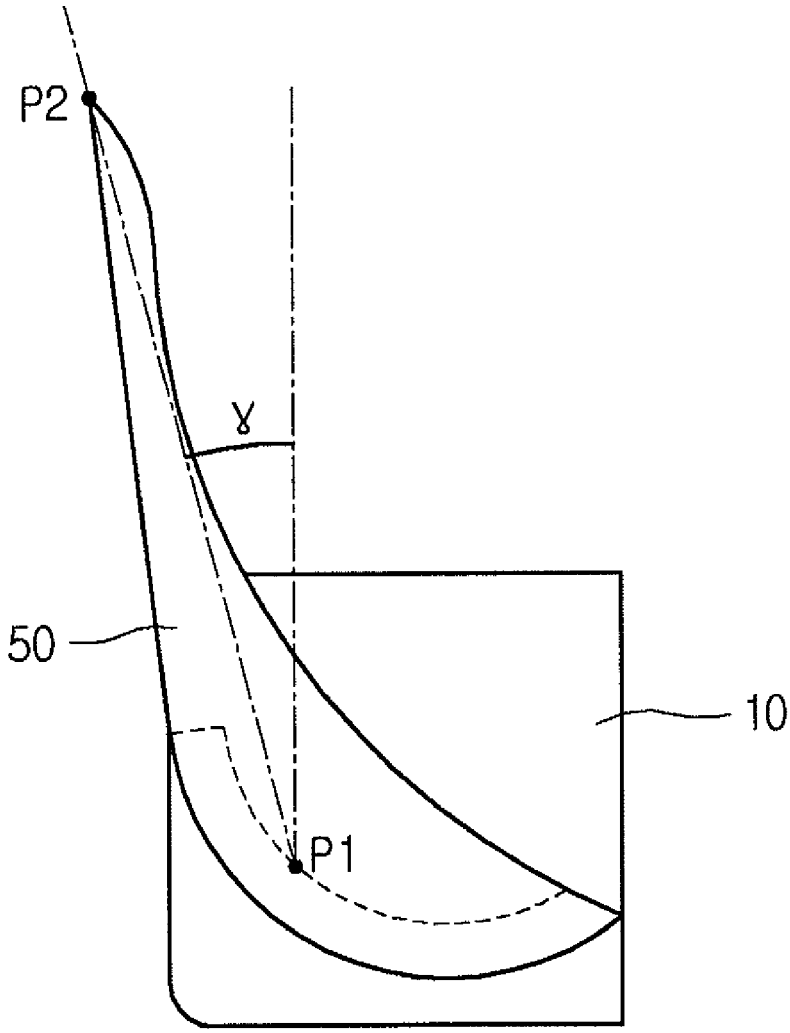
FIG. 2 is a perspective view illustrating a rake angle of the related art axial fan.
Figure 3:
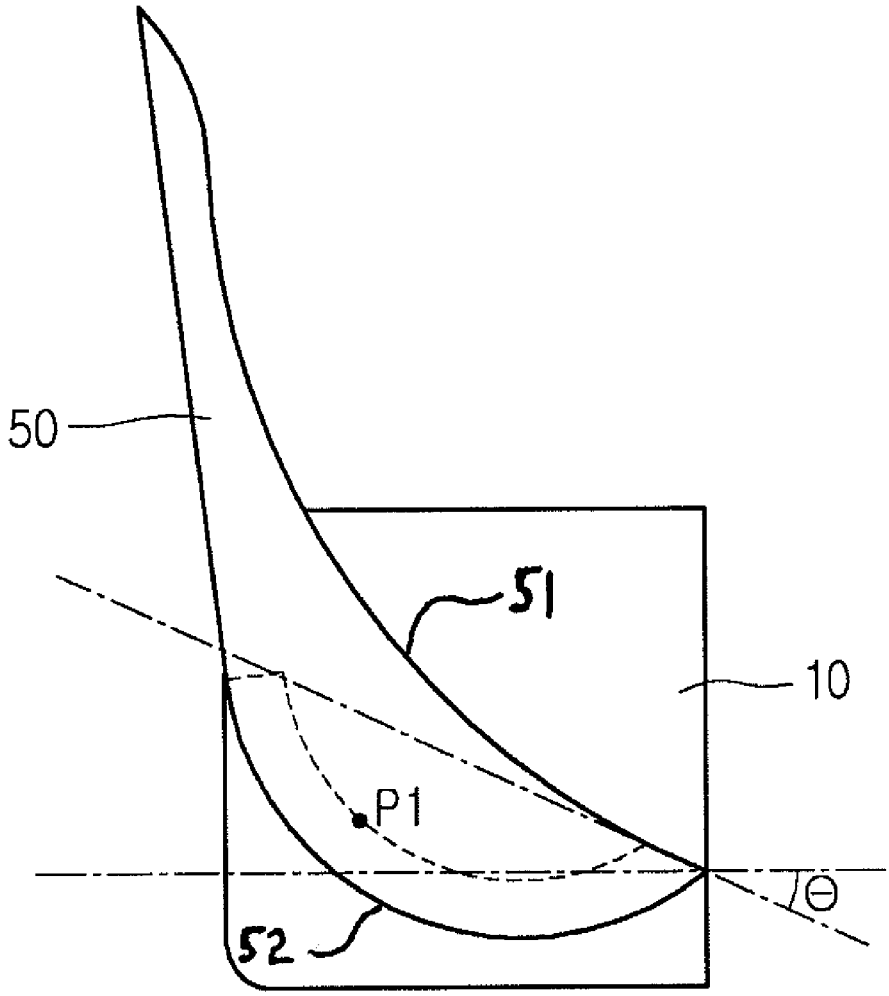
FIG. 3 is a perspective view illustrating a pitch angle of the related art axial fan.
Figure 4:
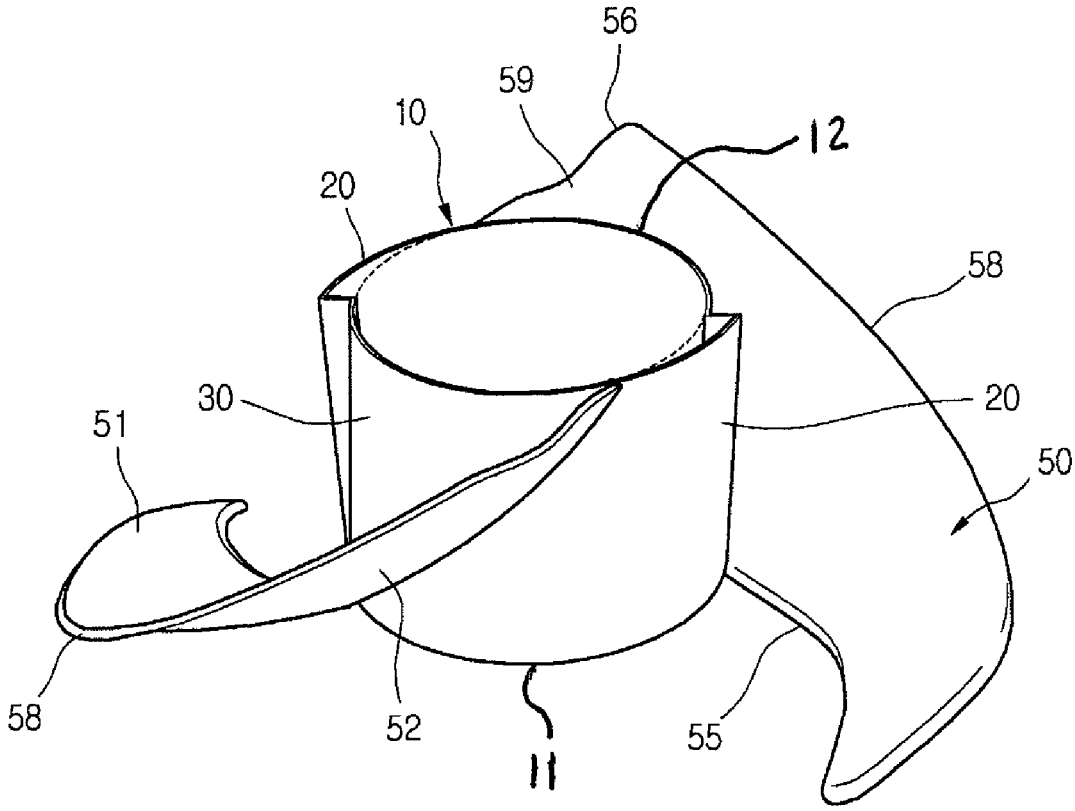
FIG. 4 is a perspective view illustrating an embodiment of an axial fan according to the present invention.

FIG. 4 is a perspective view illustrating an exemplary embodiment of an axial fan according to the present invention.

The axial fan shown in FIG. 4 includes a hub 10 and a plurality of blades 50 disposed on an outer surface of the hub 10. A leading edge 55 of the blade 50 is the edge of the blade 50 which leads when the fan rotates. A trailing edge 56 of the blade 50 is the edge of the blade 50 which trails when the fan rotates. The blade 50 also includes an outer edge 58. A positive pressure surface 51 is the surface of the blade 50 which pushes air when the fan rotates. A negative pressure surface 52 is the opposite surface of the blade 50. The hub 10 includes a cylindrical portion 30 and an inclined portion 20, which is inclined with respect to the cylindrical portion 30.

Figure 5:
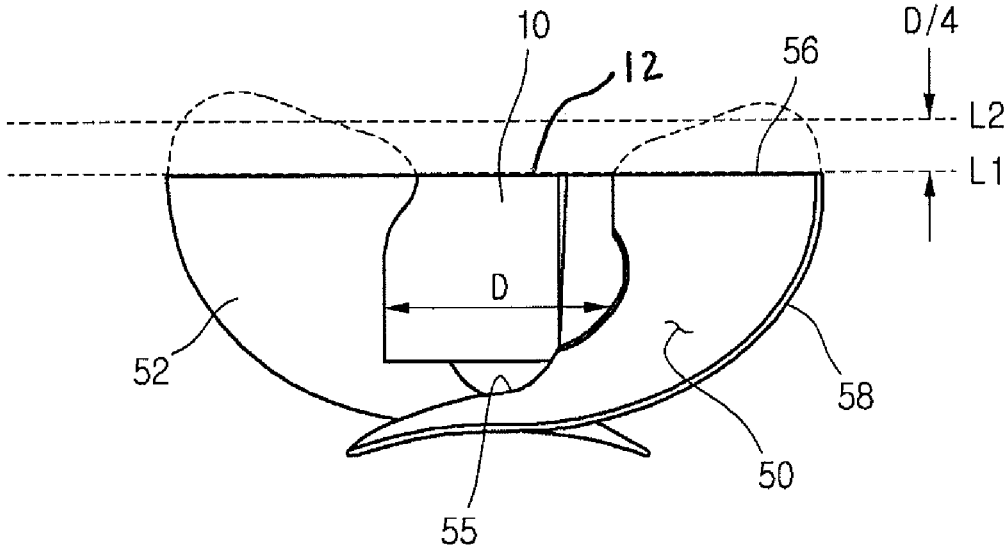
FIG. 5 is a side view illustrating blades of the axial fan of FIG. 4.
Figure 6:
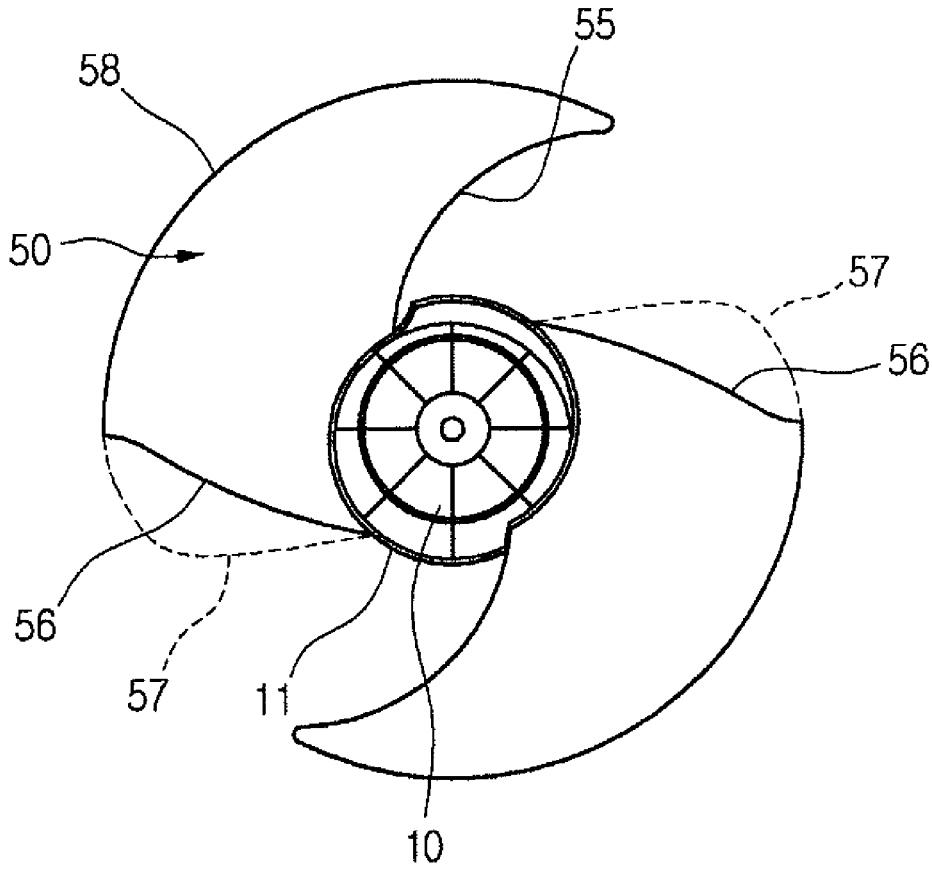
FIG. 6 is a front view illustrating the blades of the axial fan of FIG. 4.

FIG. 5 is a side view illustrating the blades 50 of the axial fan. FIG. 6 is a front view illustrating the blades 50 of the axial fan.

The axial fan may be designed using a computer program. Factors, such as a sweep angle $\Psi$, a rake angle $\gamma$, a pitch angle $\theta$, a camber, and a position of the camber, may be stored in a database, and inputted to the program. Based on these factors, the dimensions of the leading edge 55 and a standard line shape 57 of the trailing edge 56 of the blade 50 are determined. The standard line shape 57 of the trailing edge 56 is illustrated in dotted lines. The blade 50 is formed at the rake angle $\gamma$ so as to be inclined towards an air outlet end 12 with respect to a line perpendicular to a rotation axis of the hub 10.

Referring to FIG. 5, the trailing edge 56 of the blade 50 is designed so that no part of the trailing edge 56 is disposed past the air outlet end 12 (marked by the line L1) at more than a distance approximately equal to 25% of a diameter D of the hub (marked by the line L2, at a distance D/4 from the line L1). Thus, after the dimensions of a blade 50 having a standard line shape 57 are initially determined, the blade 50 is designed so that the trailing edge 56 is trimmed to the line L1, as shown in FIG. 5. Further, as shown in FIG. 5, the trailing edge 56 may lie in a plane perpendicular to the axial direction of the hub 10

When the axial fan rotates, air flows along the positive pressure surface 51 of the blade 50, in a direction from the leading edge 55 to the trailing edge 56. By designing the blade 50 such that the trailing edge 56 is disposed no further than D/4 from the air outlet end 12, the air separation which occurs at the trailing edge 56 is significantly reduced, which thereby reduces the noise of the fan.

A camber 59 may be formed near the trailing edge 56, such that the outer edge 58 curves slightly inward, towards the center of the positive pressure surface 51, as shown in FIG. 4. The camber 59 reduces the flow of air over the outer edge 58, from the positive pressure surface 51 to the negative pressure surface 52, which further reduces noise.

The rake angle $\gamma$ of the blades 50 may range from approximately 4° to approximately 8°. If the rake angle $\gamma$ is less than 4°, the air of positive pressure surface 51 flows toward an air intake end 11 over the tip 58 of the blade 50, thereby reducing the blowing amount of the axial fan. If the rake angle $\gamma$ is greater than 8°, the blade 50 will be heavily inclined toward the air outlet end 12, thereby reducing the blowing amount of the axial fan.

Figure 7:
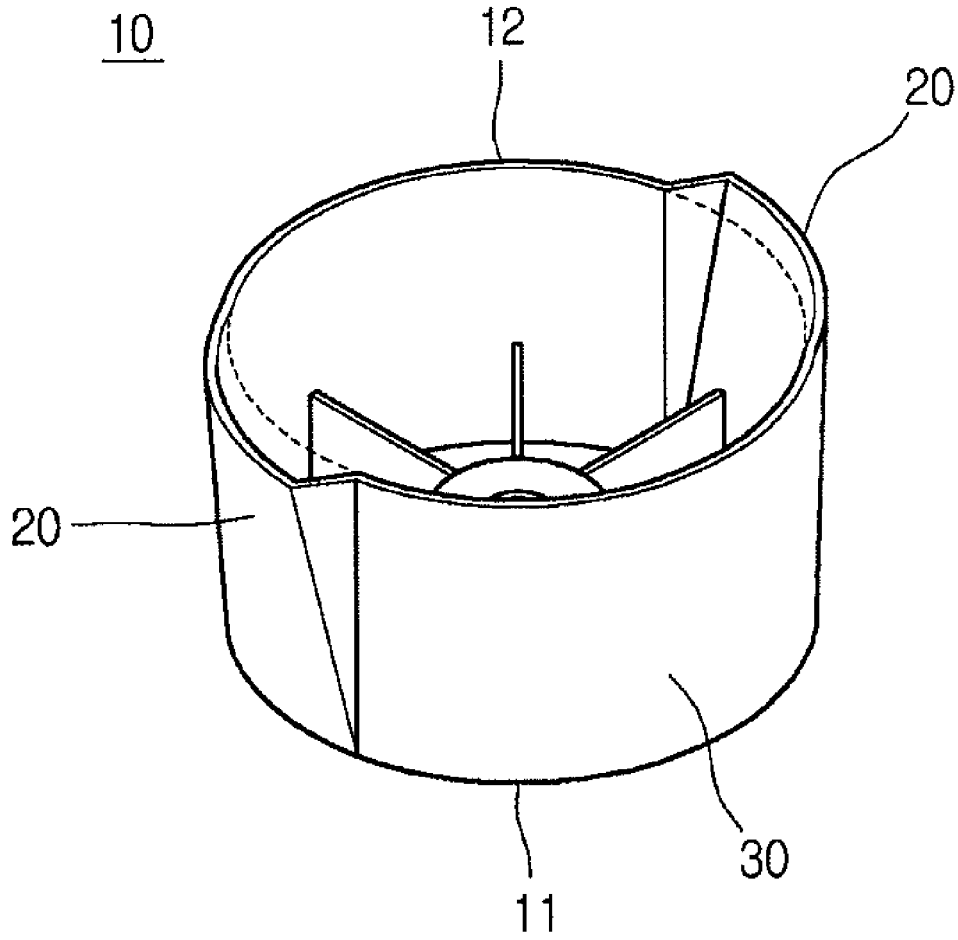
FIG. 7 is a perspective view illustrating a hub without the blades of the axial fan of FIG. 4.
Figure 8:
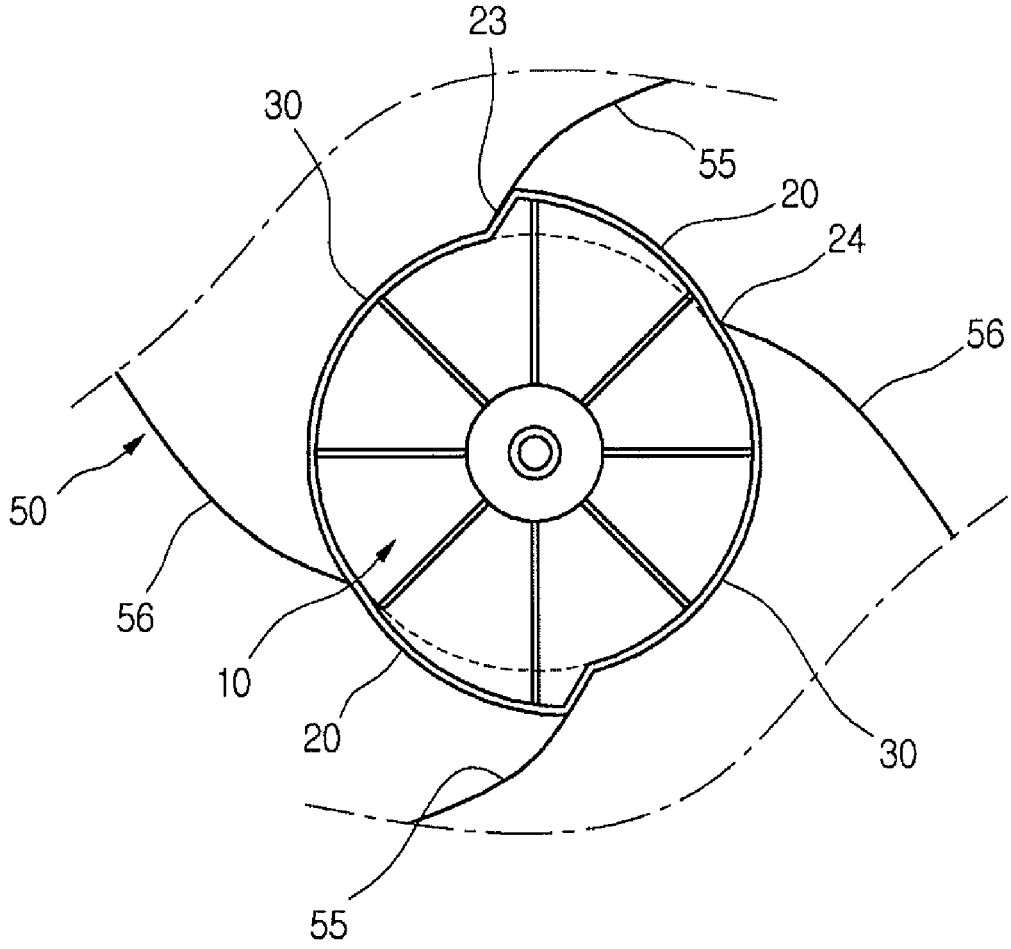
FIG. 8 is a front view illustrating the hub of the axial fan of FIG. 4.
Figure 9:
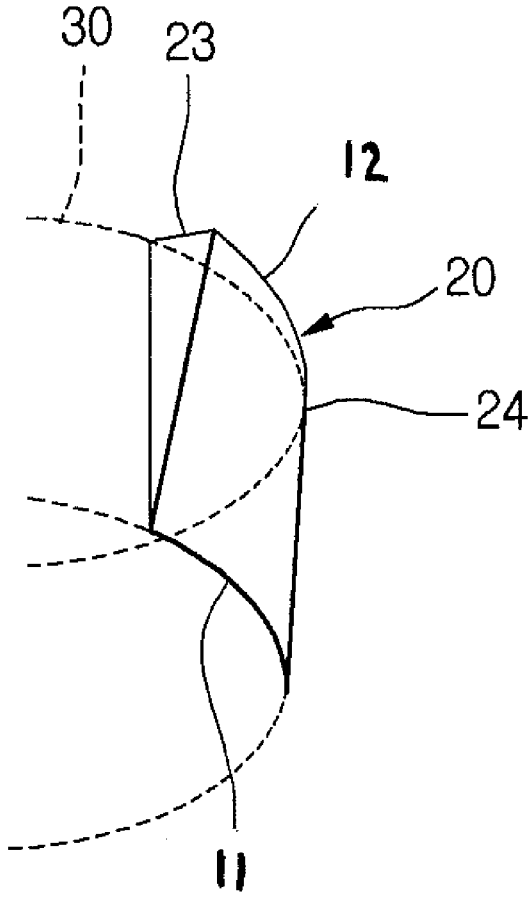
FIG. 9 is a view illustrating an inclined portion formed on the hub of FIG. 4.

FIG. 7 is a perspective view illustrating the hub 10 without the blades of the axial fan. FIG. 8 is a front view illustrating the hub 10 of the axial fan. FIG. 9 is a view illustrating the inclined portion 20 of the hub 10.

As shown in FIGS. 7 to 9, the inclined portion 20 may be formed on the outer surface of the hub 10. A non-inclined portion of the outer surface of the hub 10 is hereby referred to as a cylindrical portion 30.

The entire cylindrical portion 30 has a constant radius, as measured from the rotation axis of the hub 10. The inclined portion 20 has radii greater than that of the cylindrical portion 30.

The inclined portion 20 may be disposed in a radial direction between the leading edge 55 of a blade 50 and a trailing edge 56 of an adjacent blade 50, as shown in FIG. 8.

The inclined portion 20 may be inclined outward as it goes from the air intake end 11 toward the air outlet end 12. That is, along the inclined portion, a radius of the outer surface of the hub increases in a direction from the air intake end 11 to the air outlet end 12 of the hub 10, as shown in FIG. 7. At the air intake end 11 of the hub 10, a cross-section of the hub 10 is in the shape of a circle. Since the inclined portion 20 causes air to diffuse from the hub 10, this improves the blowing performance of the fan. In addition, when the axial fan rotates, an air flow resistance corresponding to the air intake end 11 of the axial fan is decreased. In addition, a radius of the outer surface of the hub 10 decreases in the radial direction from a leading edge 55 of a blade 10 (i.e., at a leading edge portion 23 of the inclined portion 20) to a trailing edge 56 of an adjacent blade 50 (i.e., at a trailing edge portion 24 of the inclined portion 20), as shown in FIG. 8. Thus, when the axial fan rotates, the trailing edge portion 24 is followed by the leading edge portion 23, thereby reducing an air flow resistance along the inclined portion 20.

A process of manufacturing the axial fan described above will now be described.

The factors such as the sweep angle $\Psi$, the rake angle $\gamma$, the pitch angle $\theta$, the camber, and the position of the camber of the fan are input to a mold-manufacturing device to determine the standard line shape 57, the trailing edge 56 and the leading edge 55 illustrated in FIGS. 5 and 6. As discussed above, the trailing edge 56 is designed to be shorter than the standard line shape 57.

Based on the dimensions of the designed axial fan, first and second molds (not shown) are manufactured. The first mold corresponds to the air intake end 11 of the axial fan, and the second mold corresponds to the air outlet end 12 of the axial fan.

A feature of the hub 10 is formed and a preliminary flat feature of the blade 50 is formed, and then the preliminary flat feature of the blade 50 is disposed on the hub 10. As such, the first and second molds and a preliminary axial fan is manufactured.

In addition, at the air intake end 11, the first mold supports the inclined portion 20 of the hub 10 and the negative pressure surface 52 of the blade 50. At the outlet end 12, the second mold supports the positive pressure surface 51 and the cylindrical portion 30 of the hub 10. The first and second molds surround the axial fan.

The axial fan is heated and pressed by the first and second molds.

The axial fan is formed to have the sweep angle Ψ, the rake angle γ, the pitch angle θ, and the camber by the heat and the pressure of the first and second molds.

When the axial fan has been formed, the first mold is moved toward the air intake end 11 of the axial fan, and the second mold is moved toward the air outlet end 12 of the axial fan. Since the distance between the inclined portion 20 and the rotation axis of the hub 10 increases as in the direction from the air intake end 11 toward the air outlet end 12, and the inclined portion 20 is disposed between the leading edge 55 of the blade 50 and the trailing edge 56 of the adjacent blade 50, the first mold is easily moved toward the air intake end 11. If the distance between the inclined portion 20 and the rotation axis of the hub 10 decreases as it goes from the air intake end 11 toward the air outlet end 12, the axial fan can be die-locked by the first mold.

Further, since the cylindrical portion 30 of the hub 10 has a constant radius, and the air outlet end 12 is opened at the positive pressure surface 51 of the blade 50, the axial fan is easily moved from the second mold.

As such, although the inclined portion 20 is formed between the leading edge 55 of a blade 50 and a trailing edge 56 of an adjacent blade 50, the axial fan having can be manufactured using a two plate mold.

After the first and second molds are manufactured, melted material such as plastic may be injected into the first and second molds. The first and second molds are easily divided from the axial fan, as described above.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A fan comprising:

a hub; and a plurality of blades formed on the hub with a rake angle, wherein the hub includes:

a cylindrical portion which has a constant radius; and an inclined portion which has a radius greater than that of the cylindrical portion, wherein a radius of an outer surface of the hub increases in a direction from an air intake end to an air outlet end of the hub, along the inclined portion, wherein the inclined portion is disposed in a radial direction between a leading edge of one of the plurality of blades and a trailing edge of an adjacent blade, and the radius of the outer surface of the hub decreases in a circumferential direction from the leading edge of the one blade to the trailing edge of the adjacent blade, and wherein a stepped portion is formed between the highest end of the inclined portion and the outer surface of the cylindrical portion.

2. The fan according to claim 1, wherein the trailing edge of each of the blades lies in a plane perpendicular to the axial direction of the hub.

3. The fan according to claim 1, wherein each of the blades comprises a camber near its respective trailing edge.

4. The fan according to claim 1, wherein each of the rake angles is between approximately 4° and approximately 8°.

5. The fan according to claim 1, wherein, at the air intake end of the hub, a cross-section of the hub is in the shape of a circle.

6. The fan according to claim 1, wherein the inclined portion is disposed in a radial direction between a leading edge of one of the plurality of blades and a trailing edge of an adjacent blade.

7. The fan according to claim 6, wherein along the inclined portion, a radius of the outer surface of the hub decreases in the radial direction from the leading edge of the one blade to the trailing edge of the adjacent blade.

8. The fan according to claim 1, wherein the inclined portion extends from the air intake end of the hub to the air outlet end of the hub.

9. The fan according to claim 1, wherein, in an axial direction of the hub, no part of a trailing edge of any of the blades is disposed past an air outlet end of the hub at more than a distance approximately equal to 25% of a diameter of the hub.

* * * * *